US005231935A

United States Patent [19]

Oder et al.

[11] Patent Number: 5,231,935

[45] Date of Patent: Aug. 3, 1993

[54] VAULT DOOR

[75] Inventors: Charles D. Oder; Brian Rose, both of Hamilton, Ohio

[73] Assignee: Mosler, Inc., Hamilton, Ohio

[21] Appl. No.: 816,133

[22] Filed: Dec. 31, 1991

[51] Int. Cl.[5] ..... E05G 1/04

[52] U.S. Cl. ..... 109/59 R; 109/61; 70/1.5

[58] Field of Search ..... 109/59 R,59 T, 45, 46, 109/49, 53, 54–58, 60–66, 73–78, 80–84; 70/1.5, 118, 120; 292/33, 36, 37

[56] References Cited

U.S. PATENT DOCUMENTS

| | | | |
|---|---|---|---|
| 591,200 | 10/1897 | Stevenson | 70/1.5 |
| 1,395,845 | 11/1921 | Lewis | 70/1.5 |
| 1,398,642 | 11/1921 | Lewis | 70/1.5 |
| 1,468,245 | 9/1923 | McDermott | 70/1.5 X |
| 1,473,985 | 11/1923 | Boyer et al. | 70/1.5 X |
| 1,484,772 | 2/1924 | Gray et al. | 109/59 |
| 1,607,068 | 11/1926 | Fowler | 70/1.5 |
| 1,655,975 | 1/1928 | Schmidt | 70/1.5 |
| 2,823,536 | 2/1958 | Watson | 109/59 |
| 2,947,160 | 8/1960 | Wolters | 70/1.5 |
| 2,996,322 | 8/1961 | McClellan | 109/59 X |
| 3,013,426 | 12/1961 | Taylor | 70/1.5 |
| 3,426,707 | 2/1969 | Heyl et al. | 109/59 |
| 3,735,714 | 5/1973 | Shoop | 109/59 |
| 4,053,939 | 10/1977 | Nakauchi et al. | 292/144 X |
| 4,147,044 | 4/1979 | Bernath | 70/1.5 X |
| 4,266,488 | 5/1981 | Markham | 70/1.5 X |
| 4,446,798 | 5/1984 | Withington | 109/61 |
| 4,470,275 | 9/1984 | Fisher | 70/1.5 |
| 4,679,415 | 7/1987 | Spratt | 70/1.5 X |
| 4,706,577 | 11/1987 | Jones | 70/1.5 X |

*Primary Examiner*—Peter M. Cuomo
*Assistant Examiner*—Suzanne L. Dino
*Attorney, Agent, or Firm*—Wood, Herron & Evans

[57] ABSTRACT

An improved vault door having a daylock and a relock mechanism is disclosed. The door is selectively locked and unlocked within a frame of the vault by operating a pair of combination locks mounted to the door front to slide a lock bar mounted to the rear of the door. The daylock mechanism includes a spring biased member which engages a cavity in a daylock extension attached to the lock. This engagement holds the lock bar in the unlocked position so the door may be swung within the frame without the lock bar impacting the frame. A keylock mounted in the front of the door may be turned to withdraw the member from the cavity so the lock bar can be slid to secure the door in the frame. The relock mechanism includes a pivotably mounted bar held in a horizontal position by a pin mounted to an attack plate that is displaceably mounted to a mounting plate on the rear of the door. When a drill augers through the door and impacts the attack plate, the plate moves rearwardly to move the pin out of engagement with the pivotable bar. The bar then rotates to a position where it blocks the withdrawal of the lock bar to the unlocked position regardless of any operation of the combination locks.

7 Claims, 4 Drawing Sheets

VAULT DOOR

FIELD OF THE INVENTION

This invention relates to doors on vaults, safes and the like.

BACKGROUND OF THE INVENTION

Vaults and safes have long been used to securely store articles. Such secure repositories are typically used in a bank to protect currency, negotiable paper, and safety deposit boxes. Typically, these vaults include walls, ceilings and floors made of a hardened metal outer layer backed by a thick layer of fire resistant material such as concrete. Sometimes this fire resistant material is further backed by another layer of hardened metal to provide a formidable barrier to unauthorized entry or breakage. Three of the walls, the ceiling, and the floor of the vault are encased within a reinforced concrete structure that leaves one wall exposed. This wall is provided with a framed opening in which a door is hung to provide access to the vault chamber enclosed within the walls, ceiling and floor of the vault.

The door to such a typical vault usually includes a hardened metal form having a front and four sides connected around the periphery of the front. This hardened metal form is filled with a fire resistant material. The door is hung within the framed opening on hinges mounted along one side of the door. Vertically mounted along the door edge opposed to the hinges is a lock bar. The lock bar is mounted in sliding relation to the vault door to throw or extend a portion of the lock bar beyond the edge of the vault door in a first position and to retract the lock bar within the periphery of the door in a second position. When the lock bar is in the first or thrown position and the door is closed, the lock bar portion extending beyond the door periphery lies rearward and adjacent the framed opening within the vault chamber to prevent the opening of the vault door. When the lock bar is slid to the second position to withdraw the lock bar within the periphery of the door, the door may be opened to provide access to the vault chamber.

The lock bar is connected to a cam and rod which extends through the door to a handle located on the front of the door. The handle is rotatably mounted so that by turning the handle the lock bar is moved from the first position to the second position to lock and unlock the vault door. Also mounted to the front of the door is a rotary dial of a combination lock that is connected to a rod that extends through the plate and fire resistant material to a set of tumblers and/or solenoids that control a blocking member. The end of the blocking member distal from the lock abuts the lock bar. When the vault door is closed and locked, the combination lock holds the blocking member against the lock bar to prevent the lock bar from sliding to the unlock position. By dialing in a combination to align the tumblers, the combination lock permits the blocking member to yield to the sliding of the lock bar so the door may be unlocked.

While this vault construction effectively protects the stored articles when it is locked, difficulties arise when the vault is left opened. One problem is the locking of employees within the safe either accidentally or intentionally such as when the bank or other institution is robbed. To prevent this from occurring, day locks have been designed which make the locking of the vault door without knowledge of the combination more difficult. These day locks secure the lock bar in the thrown position so the door cannot be closed within the framed opening. While such a daylock design prevents closure of the vault door after the door is opened, any attempt to close the door causes a collision between the lock bar and door frame which may result in damage to both elements.

Another daylock design holds the lock bar in a retracted position but automatically releases the lock bar when the vault door is closed to permit the locking of the door. Such a daylock effectively holds the locking bar while the door is open but anyone simply closing the door can lock employees within the vault.

What is needed is a day lock that keeps the lock bar in a retracted position once the lock bar is withdrawn and cannot be deactivated by an unauthorized person irregardless of vault door position.

Another feature added to vault doors to improve their effectiveness is a relock feature. Relocks are mechanisms which secure the lock bar in the locked position in response to an attack on the combination lock. Such a mechanism denies a burglar entry to the vault even though the burglar defeats the combination lock. Known types of relock mechanisms are activated by a frangible element located in the vicinity of the combination lock or by displacement of the combination lock itself. Both of these types of relocks present problems in their utilization. Those relocks incorporating frangible elements suffer from premature breakage of the frangible element stressed by vibrations occurring during operation of the vault door or other environmental stresses such as temperature cycling which weaken the element. Relocks which respond to the displacement of the combination lock are ineffective for attacks made through the door directly upon the blocking member in an effort to circumvent the relock mechanism.

What is needed is a relock mechanism that reduces the chances for a premature triggering of the relock and that is activated from attacks on areas of the door other than the combination lock.

SUMMARY OF THE INVENTION

The aforementioned problems in previously known vault doors have been solved by a door constructed in accordance with the principles of the present invention. Such a door includes a day lock that automatically engages the lock bar to hold it in the retracted position when the vault is unlocked and remains engaged until the day lock is deactivated by a spring biased bolt operated from a keylock. A door constructed according to the principles of the present invention also includes a relock mechanism having an attack plate that covers substantially the entire area of the door associated with the locking and unlocking of the door and which activates a blocking member to hold the lock bar in the extended position should an explosion or drill rearwardly displace the attack plate.

It is an object of the present invention to provide a day lock on a vault door which automatically engages the locking bolts in a retracted position when the door is opened. To achieve this end, an extension having a cavity near one end is connected at its other end to the lock bar. When the lock bar and extension slide to the position where the lock bar lies within the periphery of the door, a spring biased member, mounted perpendicular to the travel of the extension, is urged into the cavity to hold the extension and lock bar in place. An advantage of this structure is the retention of the lock bar within the periphery of the door so the door can be opened and closed without any collision between the door and the frame.

It is an object of the present invention to prevent locking of the door by unauthorized persons. This object is accomplished by mounting a key activated lock to the front of the door that is connected to one end of a rotating rod that extends through the door. The other end of the rod is connected by a cable to the end of the spring biased member distal from the extension. When a properly fitting key is turned in the lock, the rod is rotated to pull the cable against the action of the spring and the member to withdraw the member from the cavity in the extension. The door handle may then be turned to throw the lock bar which secures the door in the door frame. One advantage of this structure is that the door cannot be locked without the key which reduces the chance of the door being locked by an unauthorized person.

It is an object of the present invention to prevent the unlocking of the vault door in response to an attack on the vault door. The present invention achieves this operation by displaceably mounting a steel attack plate between the fire resistant material and the operative door components mounted to the rear of the door. The plate is displaceably mounted by placing springs about the mounting rivets that hold the attack plate proximate the fire resistant material. An attack through the front door plate and fire resistant material by a drill or some other impact device pushes the attack plate against the springs which compress to displace the plate rearwardly. A pivotable bar is mounted to the rear of the door so one end having a stud extending perpendicularly therefrom is proximate a notch in the locking bar. A pin mounted by a bracket to the attack plate engages a hole in the pivotable bar which keeps the bar from rotating about its pivot point. When the plate is rearwardly displaced, the pin is removed from the hole so the stud attached to the bar moves into the notch in the lock bar to block its movement to the unlocked position. The displaceable plate provides the advantage that an attack over a wide area in the vault door can trigger the relock mechanism to defeat the burglary attempt.

The objects and features of the present invention will become more readily apparent from the following detailed description taken in conjunction with the accompanying drawings in which:

DETAILED DESCRIPTION OF THE INVENTION

Figure 1:
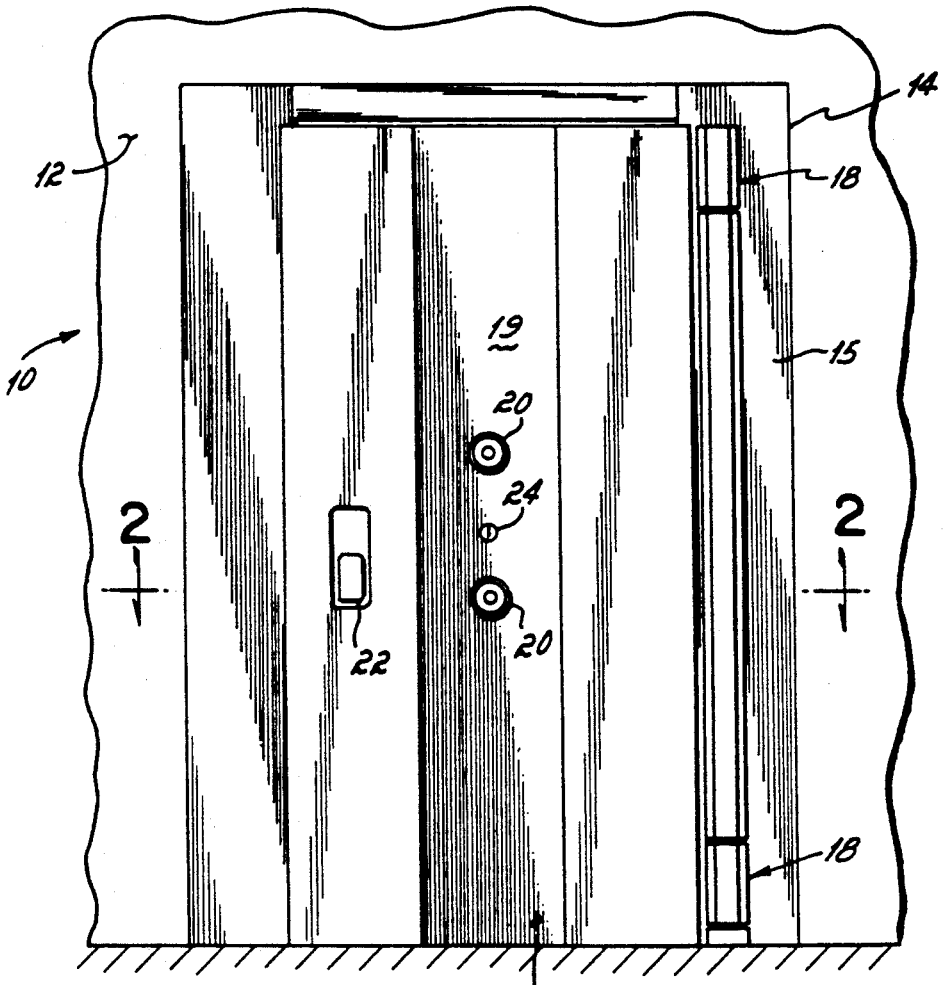
FIG. 1 is a front elevation view of a vault door.

As shown in FIG. 1, vault 10 has a front wall 12 having an opening 14 that is encased by a frame 15. Door 16 is mounted within the framed opening on hinges 18 which are mounted to frame 15 along one edge. Door 18 is closed within the frame opening, as shown, to block the access to the interior of vault 10. Door 16 may be pivoted away from frame 15 on hinges 18 to permit ingress and egress to the interior of the vault.

Also mounted to front plate 19 of door 16 are rotary dials 20 and handle 22. Explained in more detail below, dials 20 and handle 22 cooperate with components mounted to the rear of door 16 to lock the door within the frame. Lock 24 is mounted between rotary dials 20 to selectively disengage the daylock.

Figure 2:
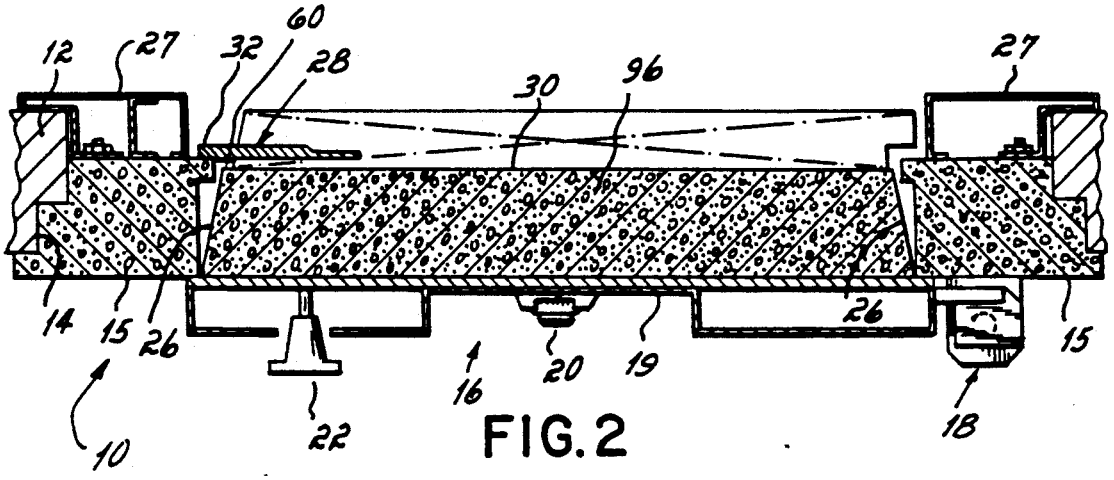
FIG. 2 is a cross-sectional view of the vault door taken along lines 2—2 of FIG. 1.

FIG. 2 shows a cross-sectional view of door 16 in the closed position with frame 15. Door 16 further includes a front plate 19 to which side plates 26 are attached by known methods. Fire resistant material such as concrete is poured into the volume formed by plates 19, 26 to provide a formidable barrier against attempts to cut through door 16. Similarly, frame 15 is filled with concrete and mounted to front wall 12 of vault 10 by an internal bracket 27. Lock bar 28 is mounted to rear surface 30 so lock bar 28 slides parallel to the rear surface of door 16. FIG. 2 shows lock bar 28 slid to its furtherest extension beyond the periphery of side plate 26 so edge 32 is behind frame 15. With lock bar 28 in this position, door 16 is locked and cannot be pivoted about hinges 18 to provide access to the interior of the vault.

Figure 3:
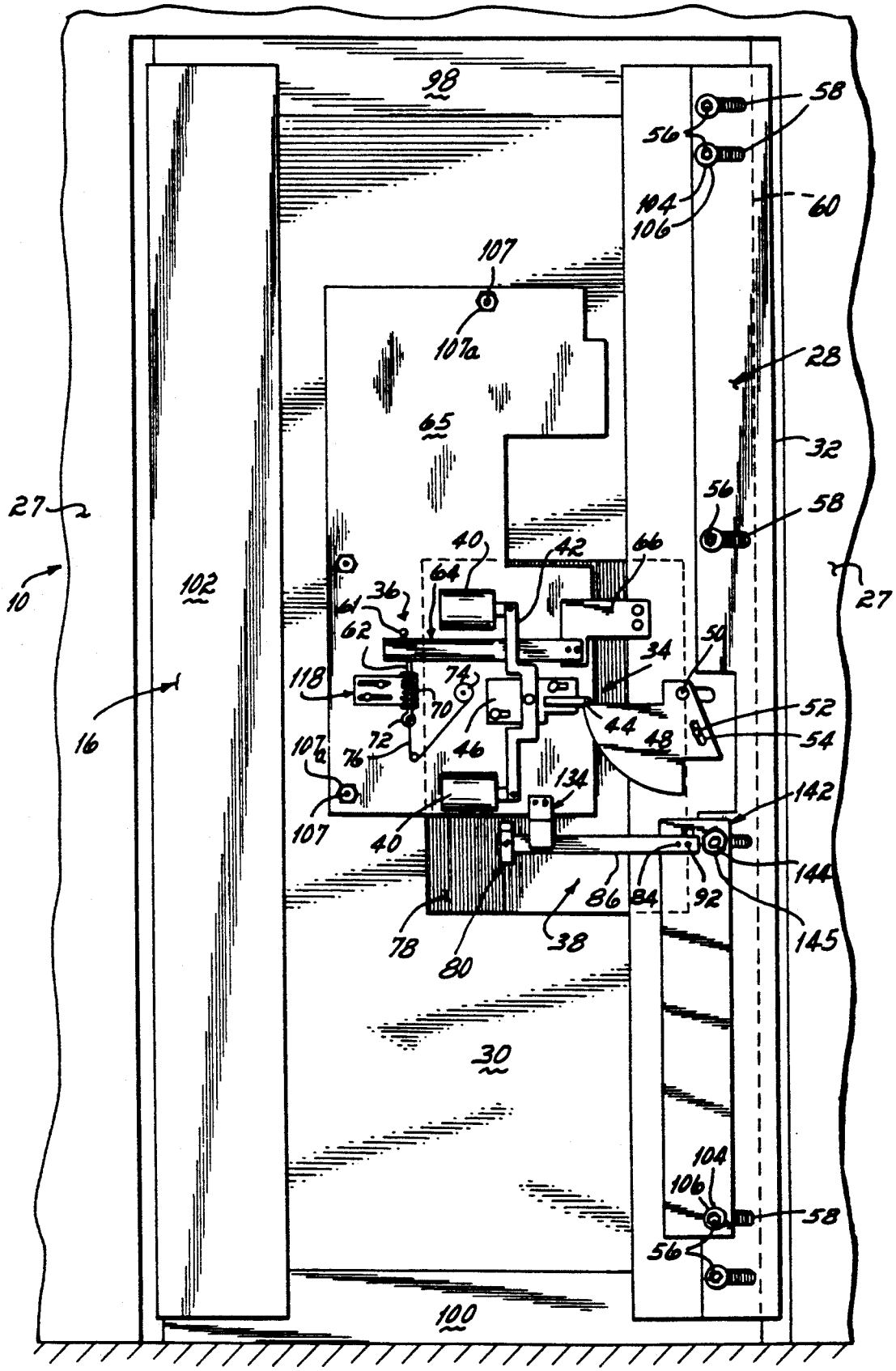
FIG. 3 is an elevational view of the rear of the vault door in FIG. 1.
Figure 4:
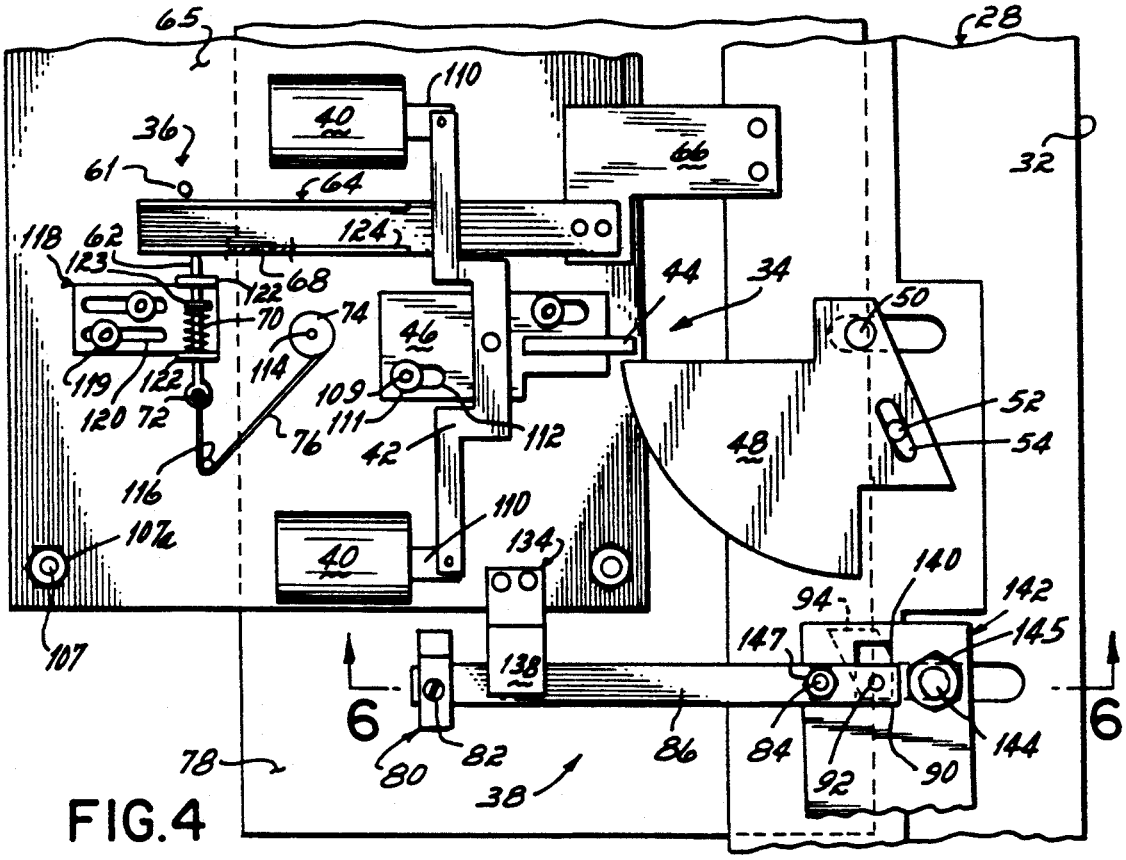
FIG. 4 is an enlarged plan view of the daylock and relocking mechanisms mounted to the rear of the door when the door is locked.

FIGS. 3 and 4 show the vault door components mounted to rear surface 30 of door 16 which cooperate with the rotary dials and handle on the front plate of the door to control the locking and unlocking of door 16. These components—locking assembly 34, daylock assembly 36, and relock assembly 38—and their operation are briefly explained with regard to FIGS. 3 and 4. Locking assembly 34 is made of combination locks 40, connecting bar 42, blocking member 44, and sliding plate 46. The rotary dials 20 are used to align tumblers within combination locks 40 to energize solenoids (not shown) within the locks. The solenoids pull connecting bar 42 towards locks 40. This action moves sliding plate 46 and blocking member 44 away from the upper edge of cam 48. Door handle 22 may now be used to clockwise rotate cam 48 via rod 50 because blocking member 44 no longer prevents cam 48 from rotating.

The rotation of cam 48 exerts a force on pin 52 which is mounted to lock bar 28 and which extends through cam slot 54 in cam 48. The force on pin 52 supplied by cam 48 causes lock bar 28 to slide towards the center of door 16. This movement is possible since lock bar 28 is mounted to the rear of door 16 by bolts 56 in lock bar slots 58. Slots 58 are sufficiently long to permit lock bar 28 to slide to a position where locking edge 32 is within edge 60 (see also FIG. 2) of door 16. In this position, lock bar 28 is no longer behind frame 15 and door 16 may be pivoted about hinges 18 to provide access to the interior of the vault.

Figure 5:
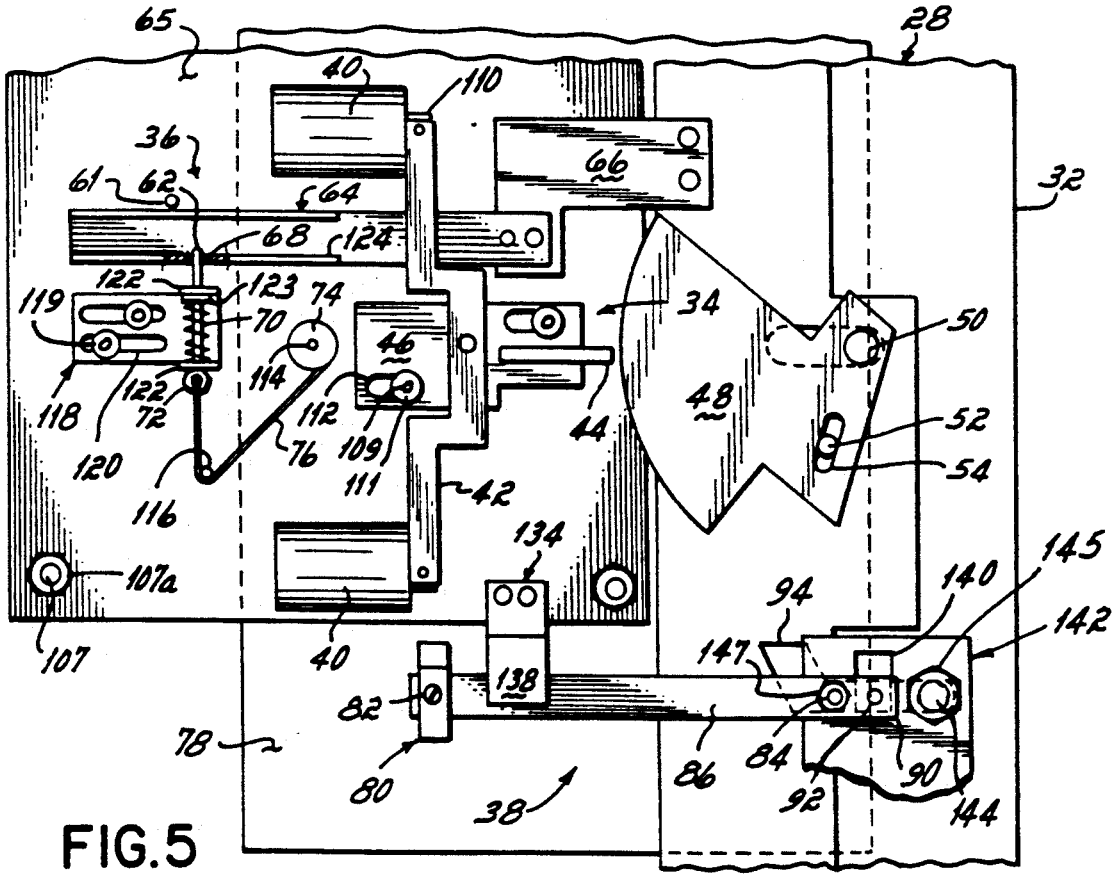
FIG. 5 is a view similar to FIG. 4, the mechanisms being shown in the door unlocked position.

As seen in FIG. 5, when locking assembly 34 is operated to open door 16, daylock assembly 36 automatically operates to hold lock bar 28 within the periphery of door 16 regardless of the position of the door, the status of locks 40, or the turning of cam 48. This safety action is achieved by the action of spring biased daylock pin member 62 becoming engaged with a daylock extension 64. Daylock extension 64 is mounted to lock bar 28 by L-shaped bracket 66. As lock bar 28 slides towards the center of door 16, daylock extension 64 is pushed by lock bar 28 in the same direction. Located in the lower edge of daylock extension 64 is daylock cavity 68. As the extension is pushed by lock bar 28, cavity 68 is aligned with daylock pin member 62. Member 62 is urged upwardly into cavity 68 by spring 70 to secure lock bar 28 in the retracted position when roll pin 61 prevents vertical movement of lock bar 28. Door 16 may now be pivoted about hinges 18 to open and close the door with respect to frame 15 without any impact between lock bar 28 and frame 15 because spring biased member 62 remains in engagement with cavity 68. Door 16 cannot be locked until a key which operates lock 24 is used to withdraw member 62 from cavity 68.

Lock 24 disengages daylock assembly 34 when a key fitting the lock is inserted and turned to rotate cylinder 74. Connecting an eyelet 72 at the lower end of daylock pin member 62 to cylinder 74 is a cable 76. As cylinder 74 rotates, cable 60 generates a downward pull on member 62 against the biasing action of spring 70 to withdraw member 62 from cavity 68. Handle 22 may now be turned to slide lock bar 28 into the locked position which pulls cavity 68 out of alignment with member 62. Blocking member 44 is returned to its cam blocking position by spinning rotary dials 20 to disengage the solenoids of locks 40.

With further reference to FIGS. 3, 4, 6 and 7, relocking assembly 36 includes an attack plate 78 which is spring mounted between the rear 30 of door 16 and mounting plate 65. Attack plate 78 covers an area of the rear 30 of door 16 sufficiently large to interpose the plate between the operative components of the locking assembly 34 and daylock assembly 36. Attached to attack plate 78 is a relock bracket 80 having a relock pin 82 mounted thereon with one end of pin 82 extending inwardly towards the rear of door 16. Any attack on the door to defeat the locking mechanisms or daylock mechanism, such as drilling, displaces attack plate 78 rearwardly and correspondingly relock bracket 80. Mounted about pivot member 84 is a relock bar 86 which has a relock cavity 88 in the end proximate the relock bracket.

Figure 6:
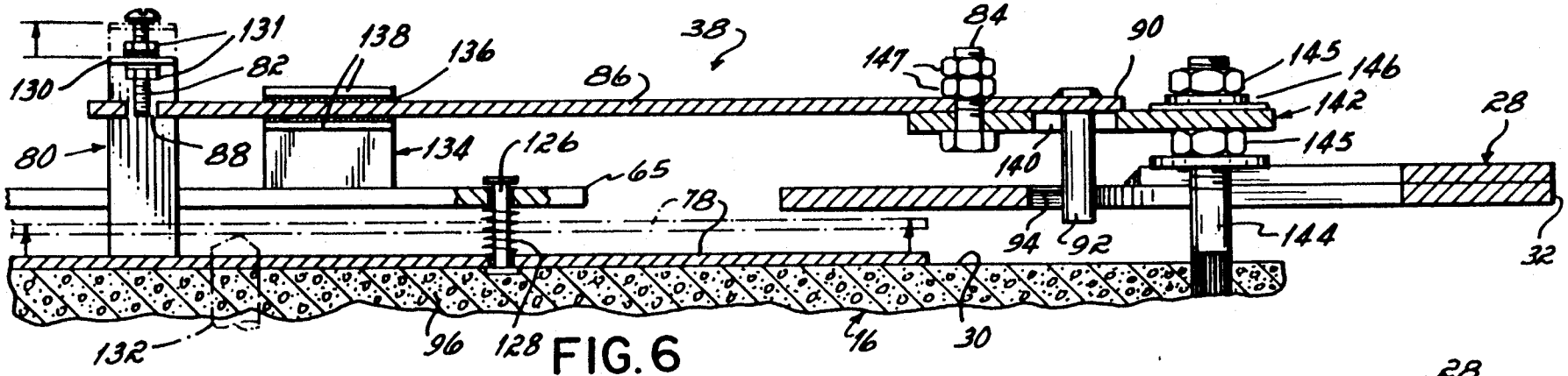
FIG. 6 is a cross-sectional view of relock mechanism taken along lines 6—6 of FIG. 4.
Figure 7:
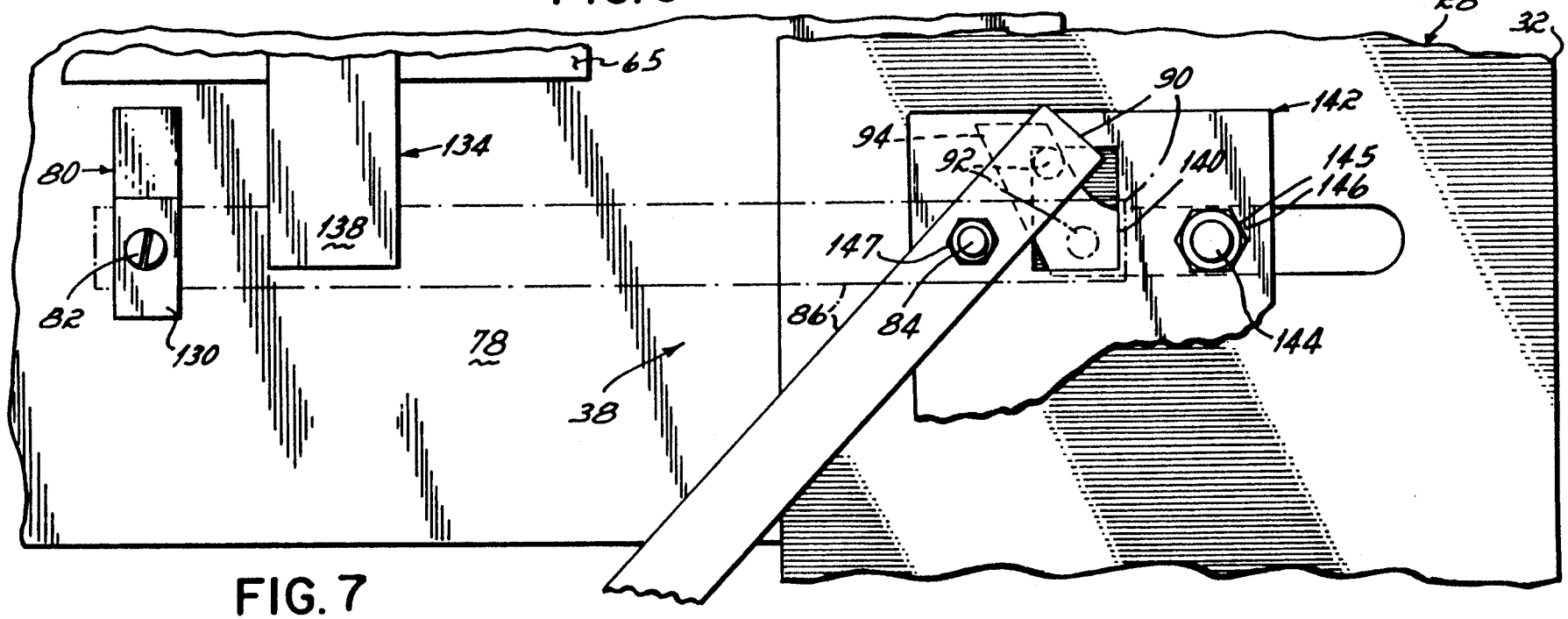
FIG. 7 is a rear plan view of the relock mechanism after an attack on the door has released the relock bar.

As shown in FIGS. 3, 6 and 7, relock bar 86 is held in position by the engagement of pin 82 in cavity 88. When attack plate 78 is displaced rearwardly, pin 82 disengages from cavity 88 causing the relock bar to rotate in a counterclockwise direction about pivot member 84. As short end 90 of relock bar 86 swings above pivot member 84 stud 92 engages notch 94 cut in lock bar 28. In this position relock bar 86 blocks any movement of lock bar 28 towards the center of door 16. This blocking action continues even though the locking assembly is compromised so as to disengage blocking member 44 from cam 48. While the vault door must be destroyed to reopen vault 10, its contents are safe from those attempting the unauthorized entry.

The components of vault door 16 are now described in more detail. As shown in FIG. 2, door 16 includes front plate 19 and side plates 26 to form a mold into which concrete 96 is poured to form a fire resistant barrier between the interior of vault 10 and the exterior front plate 19. Such door construction is well known within the art. While the fire resistant material in the preferred embodiment of the invention is concrete, other diatomaceous earth material could be used as well. Hinges 18 are also constructed by techniques well known within the art to resist attempts to defeat the locked door by disabling the hinges and attacking the door along the edge joined to the hinges.

As shown in FIG. 3, the rear of door 16 includes upper and lower plates 98 and 100 and jamb plate 102 which are attached to side plates 26. Lock bar 28 is mounted along edge 60 of door 16 by the bolts 56, washers 104 and jam nuts 106 which are threaded onto the bolts 56. These bolts are embedded in concrete 96 while it is still wet so that a threaded portion extends from concrete 96 after the concrete has solidified. These bolts are placed through lock bar slots 58 so the washers may be placed about the bolts and jam nuts 106 threaded onto the bolts to hold the lock bar against the rear door 16. Jam nuts 106 are sufficiently loosened to permit lock bar 28 to slide in lock bar slots 58 to a first position where a portion of lock bar 28 extends beyond edge 32 and to a second position where all of lock bar 28 lies within the periphery of door 16. Attached to lock bar 28 is the lock pin 52. Lock pin 52 extends through cam slot 54 in cam 48. Cam 48 is mounted to the rod 50 which extends from cam 48 forwardly through attack plate 78, lock bar 28, concrete 96, and front plate 19 to connect with handle 22. The construction and mounting of lock bar 28 is well known within the art. Notch 94 is cut in lock bar 28 to engage stud 92 of lock assembly 38 as described in detail below.

The components of locking assembly 34 and daylock assembly 36 are mounted to mounting plate 65. This plate is securely mounted to the rear of door 16 about bolts 107 which have a threaded portion that extends from concrete 96. Mounting plate 65 stands off the surface of concrete 96 by interposing sleeves or other known mechanical stand offs between the mounting plate 65 and the rear 30 of vault door 16. Mounting plate 65 is held in place on the bolts 107 by jam nuts 107*a*.

Combination locks 40 are mounted over a hole (not shown) through attack plate 78 and fixedly secured to mounting plate 65. A rod (not shown) connects the rotary dials on the front of door 16 to the combination locks 40. Rotating dials 20 in accordance with a predetermined sequence aligns tumblers (not shown) within the combination locks. The tumblers are connected to solenoids within the locks which drive reciprocating members 110 which extend from each of the locks 40. These reciprocating members are connected to sliding plate 46 via connecting bar 42 by means of bolts and nuts or the like. In order to open the vault door, both of the combination locks need to be manipulated to slide plate 46 inwardly. Combination locks 40 are well known within the art and do not form a part of the invention.

Mounted about bolts 109 extending from mounting plate 65 is the sliding plate 46 which is loosely secured to the bolts by jam nuts 111 so the plate slides along blocking slots 112 when driven by reciprocating members 110. Attached to sliding plate 46 is the blocking tongue 44. The end of blocking tongue 44 lies above and adjacent to the upper edge of cam 48 when the door is closed and in the locked position. Moving sliding plate 46 towards the hinged edge of the door withdraws blocking tongue 44 to permit the clockwise rotation of cam 48.

Daylock assembly 36 cooperates with locking assembly 34 to hold lock bar 28 in the unlocked position. When door 16 is locked the daylock assembly is in the position shown in FIG. 4. Key cylinder 74 is fixedly mounted about a rod 114. When a key is turned in lock 24, cylinder 74 rotates with rod 114. Cable 76 is connected at one end to cylinder 74, extends downwardly around fulcrum pin 116 and then upwardly to connect with the hook eye end 72 of daylock pin member 62 which in the preferred embodiment is an eye bolt. Daylock bracket 118 is mounted to mounting plate 65 by bolts through daylock bracket slots 120. Slots 120 are provided to laterally adjust the placement of bracket 118 to align member 62 with cavity 68 when lock bar 28 is in the unlocked position. Jam nuts 119 are tightened about the bolts extending through slots 120 to prevent any lateral movement of bracket 118 after it is mounted to plate 65.

Daylock pin member 62 extends through the aligned openings in the transverse flanges 122 mounted on either side of bracket 118. Sandwiched between lower flange 122 and a collar 123 fixedly secured to pin 62 is the daylock spring 70. Spring 70 urges collar 123 and thus member 62 upwardly against extension 64 which is connected to L-shaped bracket 66 by bolts and jam nuts. The other end of L-shaped bracket 66 is connected to lock bar 28 by bolts and jam nuts. The interconnecting of daylock extension 64 to lock bar 28 by L-shaped bracket 66 moves extension 64 in a reciprocating fashion as lock bar 28 is locked and unlocked. Lower flange 124 of extension 64 has cavity 68 cut therethrough. Cavity 68 is out of alignment with member 62 when lock bar 28 is in the locked position. Roll pin 61 is mounted above extension 64 to prevent vertical displacement of the extension as it slides and when member 62 is moved into engagement with cavity 68.

When lock bar 28 is slid to the unlocked position, as shown in FIG. 5, daylock extension 64 moves cavity 68 into alignment with member 62 which moves upwardly into cavity 68. Member 62 remains engaged in cavity 68 to hold extension 64 and lock bar 28 in the unlocked position until a key is turned in lock 24 to withdraw the member from cavity 68.

The cross-sectional view in FIG. 6 shows a more detailed mounting of attack plate 78 and relock bar 86. Attack plate 78 is shown mounted against concrete 96 by a doubleheaded bolt or rivet member 126 which extends from the front side of attack plate 78 to the rear side of mounting plate 65. Interposed between mounting plate 65 and attack plate 78 and concentrically about member 126 is a spring 128. Attached to attack plate 78 by welding or the like is the relock bracket 80. Bracket 80 extends rearwardly from attack plate 78 and terminates into flange 130 which is parallel to attack plate 78. Mounted within a hole in flange 130 is the relock pin or bolt 82 held within the hole by upper and lower jam nuts 131. Jam nuts 131 may be threadably adjusted to vary the length of relock pin 82 that extends into relock cavity 88 of relock bar 86.

Relock bar 86 is pivotably mounted about pivot member 84. The end 90 of relock bar 86 proximate lock bar 28 has the relock stud 92 extending therefrom towards the rear of door 16. When a drill bit 132 (shown in phantom) presses against attack plate 78, spring 128 is compressed against mounting plate 65 and the attack plate moves rearwardly towards mounting plate 65 (phantom line position of FIG. 6). This displacement correspondingly moves relock pin 82 away from cavity 88 and relock bar 86 rotates about member 84 to the solid line position seen in FIG. 7.

Anti-pivot bracket 134 is fixedly attached to mounting plate 65 and extends rearwardly to position a relock bar slot 136 formed by two relock slot flange 138. Relock bar 86 fits within slot 136 to prevent attempts to neutralize the relock mechanism by rotating the bar out of its intended rotation path when released. The slot flanges 138 do not permit relock bar 86 to be upwardly rotated or moved out of a plane parallel to attack plate 78. The restraint provided by this bracket ensures that the position of pin 82 with respect to cavity 88 is maintained and stud 92 is maintained within the notch 94 of lock bar 28 and window 140 of fixed plate 142, respectively.

Fixed plate 142 is mounted about bolts 56 and 144 by jam nuts 106 and 145 and washers 104 and 146. Pivot member 84 is inserted through relock bar 86 and fixed plate 142 and is secured by jam nuts 147. These nuts are sufficiently tightened to hold relock bar 86 in its plane of rotation but loosely enough to permit relock bar 86 to freely rotate about member 84. Stud 92 extends from relock bar 86 forwardly towards concrete 96. A portion of stud 92 passes through rectangular window or channel 140 in plate 142. Channel 140 limits the degrees of rotation relock bar 86 may move when pin 82 is released from relock cavity 88 (see FIG. 7).

With reference to FIG. 7, the notch 94, cut in lock bar 28, is in the shape of an inverted "7". As long as pin 82 is engaged in cavity 88, the forward and rear edges of notch 94 do not contact stud 92 as it is moved to its locked and unlocked positions. When pin 82 is released from cavity 88 and bar 86 rotates, stud 92 is stopped by the upper and rearward edges of channel 140 and notch 94 is wide enough to permit this movement. Since the shape of notch 94 rearwardly slopes at its forward edge, movement of lock bar 28 towards the unlocked position with stud 92 caught by channel 140 causes the forward edge of notch 94 to jam against stud 92. The clearance between stud 92 in channel 142 and the forward edge of notch 94 is insufficient to permit lock bar 28 to clear the periphery of door 16 and the door remains locked. Thus, any attempt to neutralize the locking features protected by attack plate 62 results in lock bar 28 being held in place regardless of the action of combination locks 38 or handle 22.

While the present invention has been illustrated by the description of a preferred embodiment and while the embodiment has been described in considerable detail, it is not the intention of the applicants to restrict or any way limit the scope of the appended claims to such detail. Additional advantages and modifications will readily appear to those skilled in the art. The invention in its broader aspects is therefore not limited to the specific details, representative apparatus, and illustrative example shown and described. Accordingly, departures may be made from such details without departing from the scope or spirit of applicants' general inventive concept.

What is claimed is:

1. In a vault door having a metal casing with a front plate and four sides extending therefrom, said metal casing being filled with fire resistant material to form a rear surface of the vault door, a lock bar slidably mounted to the rear surface of the vault door along a first edge, a handle mounted to the front plate and having a rod extending through the front plate and the fire resistant material to connect with a cam and the lock bar so that turning the handle slides the lock bar from a first position to a second position, when the lock bar is in the first position a portion of the lock bar extends beyond the first edge of the vault door rearward of the door frame to secure the vault door within the frame, when the lock bar is in the second position the lock bar lies within the periphery of the door, a plurality of hinges mounted to the front plate and along the edge of the door opposed to the first door edge so the door may be pivoted about an axis to open and close the door relative to the frame when the lock bar is in the second position, a lock mounted to the front plate and connected to a blocking member on the rear of the door for selectively locking the blocking member, the blocking member preventing the movement of the lock bar from the first position to the second position to lock the door within the door frame, the improvement comprising:

an attack plate displaceably mounted to the rear surface of the fire-resistant material;

a pivot fixedly mounted to the rear surface of the fire-resistant material;

a relocking bar eccentrically mounted about said pivot, said bar having first and second ends and a cavity located between said first and second ends; and a pin fixedly connected to said attack plate and located so said pin engages said cavity in said relocking bar, said pin preventing said bar from rotating about said pivot when said pin engages said cavity until a blow or other impact pressure applied to said attack plate of the vault door in an attempt to defeat the locked door causes said attack plate to be rearwardly displaced from the rear surface to remove said pin from said cavity in said relocking bar so that said first end of said relocking bar rotates about said pivot to engage the lock bar whereby movement of the lock bar from the first position to the second position is prevented regardless of any rotation of the handle or disengagement of the blocking member with the lock bar.

2. The vault door improvement of claim 1 further including:

a stud projecting from the first end of said relocking bar;

a channel cut in the lock bar, said channel having a shape so that a front edge of said channel prevents engagement of the lock bar and said stud as the lock bar is moved between the first and second positions when said pin engages said cavity in said relocking bar and said front edge of said channel contacts said stud as the lock bar is moved from the first position to the second position when the relocking bar pivots about said pivot member; and a stop mounted to the rear of the door proximate to said lock bar so that said stud projecting from said relocking bar is halted by said stop when said relocking bar rotates about said pivot to prevent the lock bar from moving from said first position to said second position.

3. The vault door improvement of claim 1 further including:

a bracket mounted to said attack plate for holding said pin in engagement with said cavity so said relocking bar is interposed between said pin and said attack plate.

4. The vault door improvement of claim 1 wherein said attack plate is located so said attack plate is interposed between the fire resistant material and any elements for unlocking the vault door.

5. The vault door improvement of claim 1 further comprising:

elongated members for attaching said attack plate to the rear of the vault door; and a spring concentrically mounted about each of said elongated members and interposed between the rear of the vault door and said attack plate so pressure on said attack plate compresses said spring and displaces said attack plate rearwardly.

6. In a vault door having a metal casing with a front plate and four sides extending therefrom, said metal casing being filled with fire resistant material to form a rear surface of the vault door, a lock bar being slidably mounted to the rear surface of the vault door along a first edge, a handle being mounted to the front plate and having a rod extending through the front plate and the fire resistant material to connect with a cam and the lock bar so that turning the handle slides the lock bar from a first position to a second position, when the lock bar is in the first position a portion of the lock bar extends beyond the first edge of the vault door rearward of the door frame to secure the vault door within the frame, when the lock bar is in the second position the lock bar lies within the periphery of the door, a plurality of hinges mounted to the front plate and along the edge of the door opposed to the first door edge so the door may be pivoted about an axis to open and close the door relative to the frame when the lock bar is in the second position, a lock mounted to the front plate and connected to a blocking member on the rear of the door for selectively locking the blocking member, the blocking member preventing the movement of the lock bar from the first position to the second position to lock the door within the door frame, the improvement comprising:

an extension connected at one end to the lock bar and substantially perpendicular to the lock bar, said extension having an opening intermediate the connected end and a free end;

a pin having one end adjacent said extension and being oriented substantially perpendicular to said extension;

means for biasing said pin to urge said pin into contact with said extension; and a rotatable rod extending through the vault door;

means for turning said rotatable rod, said turning means being mounted to the front plate of the vault door; and linking means operatively connected at one end to said pin and at the other end to said rotatable rod;

said pin under the action of said biasing means engages said opening in said extension when the lock bar is in the second position to hold said extension and the lock bar in the second position to permit the vault door to swing freely about its hinges without contacting the door frame, said linking means selectively retracting said pin from said opening in said extension in response to said rotatable table rod being rotated by said turning means so the lock bar and said extension may only be moved to said first position by the operation of said turning means.

7. The vault door improvement of claim 6 wherein said turning means is a key lock whereby the operation of said turning means is controlled by limiting access to the key.

* * * * *